United States Patent [19]

Basch

[11] 4,284,390

[45] Aug. 18, 1981

[54] COLLAR

[75] Inventor: Walter E. Basch, St. Louis, Mo.

[73] Assignee: ACF Industries, Inc., New York, N.Y.

[21] Appl. No.: 80,263

[22] Filed: Oct. 1, 1979

[51] Int. Cl.[3] ..... F04B 39/12; F04B 39/60

[52] U.S. Cl. ..... 417/313

[58] Field of Search ..... 417/313, 470, 570, 571; 285/260; 92/98 R, 102

[56] References Cited

U.S. PATENT DOCUMENTS

| | | | |
|---|---|---|---|
| 3,119,411 | 1/1964 | Bock et al. | 285/260 |
| 3,683,137 | 8/1972 | Stiltner | 92/102 |
| 3,759,553 | 9/1973 | Carter | 285/260 |
| 3,912,423 | 10/1975 | Pfabe | 417/313 |

FOREIGN PATENT DOCUMENTS

| | | | |
|---|---|---|---|
| 1334937 | 10/1973 | United Kingdom | 417/471 |

*Primary Examiner*—William L. Freeh

*Attorney, Agent, or Firm*—J. Joseph Muller

[57] ABSTRACT

A collar sized to fit over a fuel pump tower at the outer end of the tower. The collar has an opening sized to accomodate a conduit integrally formed with the tower thus for the collar to fit about the conduit. The collar is attachable to the tower to reinforce the tower so the tower does not tear when the tower or conduit is subjected to abnormal forces during a crash.

3 Claims, 3 Drawing Figures

COLLAR

BACKGROUND OF THE INVENTION

This invention relates to fuel pumps and, more particularly, to an improvement by which fuel pumps are made more crashworthy.

Certain fuel pump designs have features which may contribute to fuel leakage from the pump if the pump is struck by debris during a crash. For example, the tower design of some pumps are such that the sheet metal body of the pump may be torn during a crash. Fuel may then spill out of the pump into the engine compartment thus creating a fire hazard.

SUMMARY OF THE INVENTION

Among the several objects of the present invention may be noted the provision of a fuel pump improvement which enhances the crashworthiness of the fuel pump; and the provision of such an improvement which is readily installed on a fuel pump without requiring modification thereto.

Briefly, the improvement of the present invention comprises a collar sized to fit over a fuel pump tower at the outer end of the tower. The collar has an opening sized to accommodate a conduit integrally formed with the tower thus for the collar to fit about the conduit. The collar is attachable to the tower to reinforce the tower whereby the tower does not tear when the tower or the conduit is subjected to abnormal forces during a crash. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
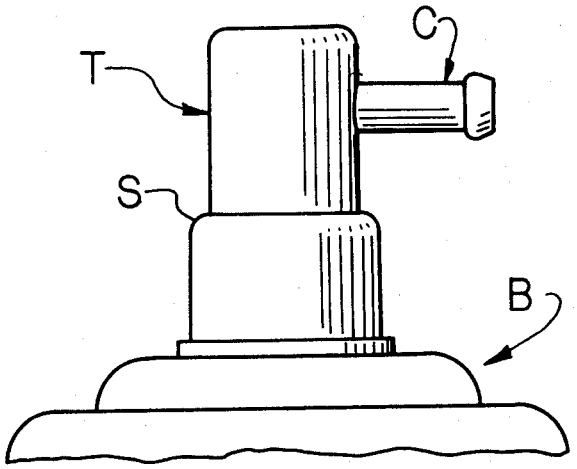
FIG. 1 is a side elevational view of a portion of a fuel pump.

Referring to the drawings, FIG. 1 illustrates a portion of a fuel pump body B. Body B is of one-piece, thin-walled, sheet metal construction and has formed therein a fuel intake cavity and a fuel discharge cavity. One or both of these cavities is defined by a cylindrical shaped or round tower T which outwardly projects from the pump body. The tower has a lower section and an upper section, the upper section being of smaller diameter than the lower section and a shoulder S being formed at the location where the change in diameters is made. A fuel conduit C is formed integrally with the tower, the conduit being an attachment point for a fuel hose by which the fuel pump is connected into a fuel system.

It has been found that if conduit C is struck with a blow such as might occur during an accident, the sheet metal portion of the tower adjacent the conduit may tear due to the abnormal force applied and a fuel leak may result. Leakage of fuel in an engine compartment is extremely hazardous because of fire risk and should be prevented if possible.

The improvement of the present invention is intended to prevent the above-described event from happening. The improvement comprises a collar or band 1 sized to fit over the outer end of tower T. Collar 1 is a circular band of material, for example, a sheet metal similar in composition to the pump body material. The collar has an inner diameter substantially equal to the outer diameter of the upper section of the tower and the height of the collar also substantially equals the height of the upper section of the tower.

Figure 2:
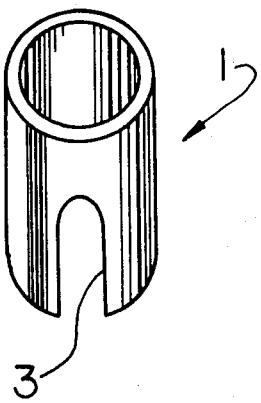
FIG. 2 is a perspective view of the improvement of the present invention.

Collar 1 further has an opening 3 sized to accommodate conduit C. As shown in FIG. 2, opening 3 forms a slot whose length is substantially the same as the height of the upper surface of conduit C above shoulder S.

Figure 3:
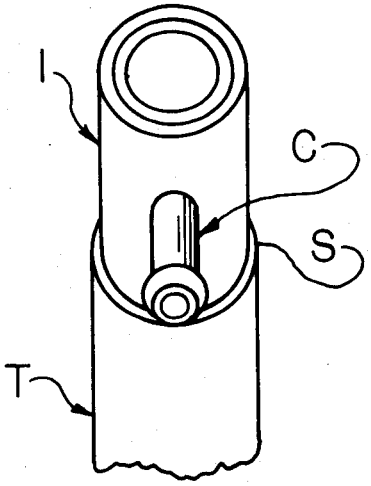
FIG. 3 is a perspective view illustrating installation of the present invention on a fuel pump.

Collar 1 is readily installed over the upper section of tower T as shown in FIG. 3 with the base of the collar resting on shoulder S. The collar is attached to the tower by brazing or welding to reinforce the tower. Now, the added strength given to the tower by the collar prevents pump body B from tearing if the conduit is subjected to abnormal crash forces. This helps reduce the possibility of a fuel pump leaking resulting from a crash.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a fuel pump for use in an automotive fuel system, the fuel pump including a body having a fuel intake cavity and a fuel discharge cavity, one of the respective cavities being defined by a tower formed in the body and the tower having a fuel conduit formed integrally with the tower at the outer end thereof, the conduit projecting outwardly from the tower and the tower being subject to tearing when the conduit is subjected to abnormal forces such as occur during a crash, the improvement comprising a metal collar sized to fit over the tower at its outer end, the collar having an opening therein sized to accommodate the conduit whereby the collar is fitted about the conduit and the collar being attachable to the tower to reinforce the tower whereby the tower does not tear when the conduit is subjected to abnormal forces.

2. The improvement as set forth in claim 1 wherein the tower is rounded and the collar is a circular band of material whose inner diameter is substantially equal to the outer diameter of the tower.

3. The improvement as set forth in claim 1 wherein the opening in the collar forms a slot.

* * * * *